United States Patent [19]

Schulz

[11] 4,362,212

[45] Dec. 7, 1982

[54] METHOD FOR ENHANCED PETROLEUM OIL RECOVERY

[76] Inventor: Helmut Schulz, 611 Harrison Ave., Harrison, N.Y. 10528

[21] Appl. No.: 164,439

[22] Filed: Jun. 30, 1980

Related U.S. Application Data

[63] Continuation-in-part of Ser. No. 58,635, Jul. 19, 1979, abandoned.

[51] Int. Cl.[3] ..... E21B 43/22; E21B 43/30; E21B 43/40

[52] U.S. Cl. ..... 166/245; 166/263; 166/266

[58] Field of Search ..... 166/245, 263, 265–267, 166/274

[56] References Cited

U.S. PATENT DOCUMENTS

| | | | |
|---|---|---|---|
| 2,135,319 | 11/1938 | Bays | 166/266 |
| 2,297,832 | 10/1942 | Hudson | 166/266 |
| 2,386,036 | 10/1945 | Cross | 166/266 |
| 2,601,599 | 6/1952 | Deming | 166/266 |
| 2,729,291 | 1/1956 | Haverfield | 166/266 |
| 2,878,874 | 3/1959 | Allen | 166/266 |
| 3,064,728 | 11/1962 | Gould | 166/263 X |
| 3,101,782 | 8/1963 | Holm | 166/263 |
| 3,137,344 | 6/1964 | Wiemer | 166/266 X |
| 3,143,169 | 8/1964 | Foulks | 166/263 X |
| 3,252,512 | 5/1966 | Baker et al. | 166/263 |
| 3,256,933 | 6/1966 | Murphree et al. | 166/266 |
| 3,266,569 | 8/1966 | Sterrett | 166/263 |
| 3,402,768 | 9/1968 | Felsenthal et al. | 166/263 X |
| 3,434,541 | 3/1969 | Cook et al. | 166/263 X |
| 3,823,777 | 7/1974 | Allen et al. | 166/266 |
| 3,989,478 | 11/1976 | Jones | 166/267 X |
| 4,224,992 | 9/1980 | Comberiati et al. | 166/274 X |

*Primary Examiner*—Stephen J. Novosad
*Assistant Examiner*—George A. Suchfield
*Attorney, Agent, or Firm*—Lawrence Rosen

[57] ABSTRACT

An enhanced petroleum oil recovery method for increasing the quantity of oil recoverable from an underground deposit thereof is provided which involves injecting into a first point in such deposit a liquid mixture of low molecular weight, light hydrocarbons; alternately reducing and raising the back pressure exerted on said deposit so as to alternately induce boiling and condensation of said light hydrocarbon mixture; recovering from a second point in said deposit under controlled back pressure a mixture of said light hydrocarbons and oil; separating the light hydrocarbons from the extracted petroleum oil by distillation; and then recycling the light hydrocarbons to the injection step. Another aspect of the invention involves utilizing the essential features thereof for the recovery of oil from oil-bearing sands, e.g. tar sands, which are mined and brought to the surface.

11 Claims, 1 Drawing Figure

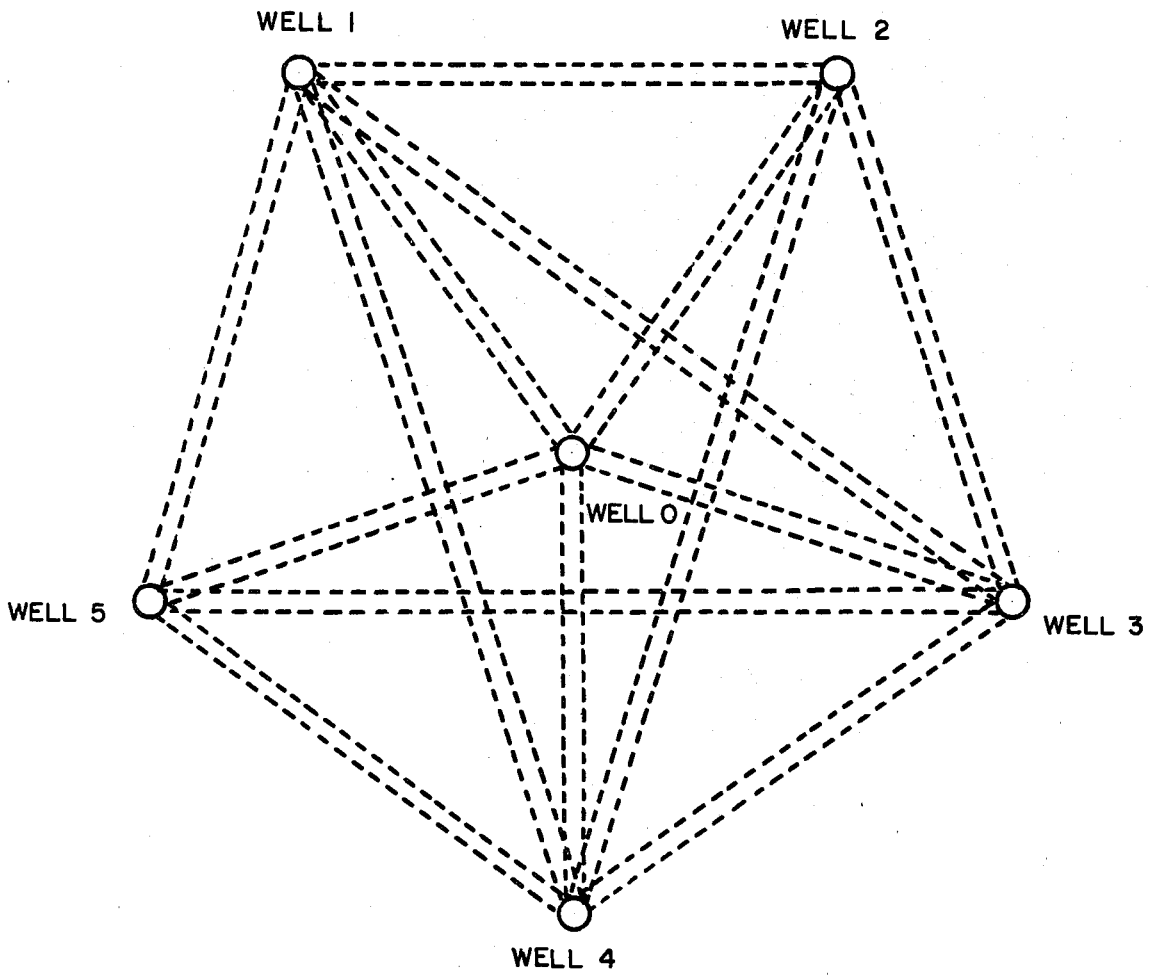
WELL 1
WELL 2
WELL 0
WELL 5
WELL 3
WELL 4

METHOD FOR ENHANCED PETROLEUM OIL RECOVERY

This application is a continuation-in-part of Ser. No. 058,635 filed July 19, 1979, now abandoned.

BACKGROUND OF THE INVENTION

The production of petroleum oil from underground deposits such as porous sandstone reservoirs is effected by drilling a well into such deposit. Since the pressure at the deposit is greater than the pressure at the surface of the well, the petroleum oil flows upwardly. The pumping of a well until the spontaneous flow is exhausted is termed "primary" production in the art and is generally characterized by recovering, on average, about 17% of the crude petroleum oil present in the desposit.

A substantial additional amount of oil can be recovered from the "exhausted" reservoir by flooding it with water by means of an injection well so as to displace the oil toward an adjacent producing well. This operation is termed "secondary" production and is widely practiced in order to recover an additional 15% of the total oil in the reservoir. The use of relatively sophisticated means to further enhance oil recovery from about 32% to about 35–38% is termed "tertiary" production. Thus, for every barrel recovered by primary and secondary production means, there are two barrels of oil left in the reservoir which invite recovery by tertiary production methods. A great deal of laboratory work and field work have been done over the past fifty years in order to develop and improve tertiary or enhanced oil recovery technology.

The recent dramatic increase in the cost of imported crude petroleum oil has generated even more interest in enhanced oil recovery. Among the methods that have been employed to secure tertiary production are surfactant flooding, polymer flooding, methane flooding, carbon dioxide flooding, and "fire" flooding. The last named method is the most widely employed and accounts for about 60% of enhanced oil recovery procedures. It involves subjecting the reservoir to higher temperatures in order to reduce viscosity while also providing a displacement medium to drive the released oil to the producing well. In one method of fire flooding an in situ combustion of some of the retained oil is achieved by pumping air or oxygen into the deposit through the injection well. It is also known to inject water for conversion to steam by partially quenching the underground fire. Alternatively, high pressure steam can be directly injected to drive the mobilized oil to a production well or the steam treatment is applied cyclically into a given well by alternating injection and production phases in the so called "huff and puff" mode of stream flooding.

In U.S. Pat. No. 2,412,765 propane and butane vapors are injected into a well and allowed to condense in the reservoir, thereby transferring a large quantity of energy into the reservoir. The mixture of condensed hydrocarbon vapors and condensed oil is then allowed to drain by gravity to the well bore of the producing well from which it is recovered by pumping. There is no positive displacement of the mixture as would be the case if a liquid solvent were injected under sufficient pressure to maintain it in the liquid state.

SUMMARY OF THE INVENTION

This invention relates to an enhanced oil recovery method. In one embodiment it involves the injection of a liquid mixture of low molecular weight hydrocarbons into an oil formation by means of an injection well against an imposed back pressure of a non-condensible gas, said back pressure being regulated by throttling said gas at the vent of a production well penetrating said formation so as to maintain a pressure level on the formation higher than the vapor pressure of the light hydrocarbon mixture at the ambient temperature of said oil formation; reducing said back pressure for a substantial interval of time below the vapor pressure of said light hydrocarbon mixture; then raising said back pressure above the vapor pressure of said light hydrocarbon mixture at the ambient temperature of said oil formation so as to cause condensation of the vaporized hydrocarbon mixture for a substantial period of time; repeating said boiling and condensation cycles one or more times in the aforesaid manner; recovering a mixture of said hydrocarbons and dissolved petroleum oil from at least one producing well which penetrates said oil formation; separating by distillation the low molecular weight hydrocarbons and the extracted petroleum oil; and recycling the recovered hydrocarbon distillate to the injection step.

In another embodiment the method involves the mining of oil-bearing sands (also termed "tar sands") from an underground deposit; charging said tar sands to a pressure vessel equipped with a heating means and connected operably to a condensing means; injecting a light hydrocarbon mixture into said pressure vessel (also termed "still kettle"); maintaining a blanket of a non-condensible inert gas on said pressure vessel and condensor system through a pressure regulating device; heating the charge of said still kettle by admitting steam to said heating means; reducing the back pressure on the system so as to cause the light hydrocarbon mixture to boil in contact with the tar sands for a period of time while simultaneously condensing the vaporized hydrocarbon mixture in said condensing means and refluxing it to the still kettle; raising the back pressure of said still system and discharging a solution of petroleum oil extract dissolved in said light hydrocarbon mixture; distilling said solution to separate the light hydrocarbon solvent (to be recycled) from the higher boiling petroleum extract which thus has been recovered from said charge of tar sands.

DETAILED DESCRIPTION OF THE INVENTION

The process of the present invention generally can be applied to oil fields which have been subjected to primary and secondary production and to some oil fields which have also been subjected to the conventional tertiary production means. The process requires the use of at least two wells, one being an injection well and one being a producing well and a mixture of low molecular weight hydrocarbons which are maintained predominantly in the liquid phase.

The low molecular weight hydrocarbons employed in the present process are those containing 2 to about 5 carbon atoms such as ethane, propane, isobutane, normal butane, pentanes, and the like. A mixture of such light aliphatic hydrocarbons is used, and the particular combination is selected so that a liquid phase can be maintained in the pores of the oil sands being treated with due regard for the temperature at the producing well. The mixtures can be secured as liquid concentrates from the "stabilization" of natural gas from proximate natural gas wells or can be those produced during the cracking and refining of petroleum products. A particularly desirable mixture is the mixture of hydrocarbons known commercially as liquified petroleum gas or LPG. Any hydrocarbon which is in the gaseous phase is condensed before having introduced into the injection well.

The injected liquid hydrocarbons serve three purposes. Firstly, they leach the petroleum constituents from the oil impregnated saids thus rendering the oil recoverable. Secondly, the liquid serves to reduce the viscosity of the resulting solution. Thirdly, the liquid hydrocarbon mixture constitutes a displacement medium to drive the released oil to the producing well.

The admixture of the liquid hydrocarbon and petroleum oil is recovered by conventional means through the production well. It is important to maintain the hydrocarbon mixture in the liquid phase in the oil producing deposit for a preponderant fraction of the time. The producing well is accordingly throttled in order to create a back-pressure in the formation sufficient to maintain the hydrocarbon mixture in the liquid phase at the ambient temperature in the formation.

In accordance with another important embodiment of the present invention, the back-pressure is periodically reduced and raised, so that the resulting programmed pulsing of the back-pressure of the producing well causes the hydrocarbon mixture to boil and recondense in situ in the oil deposit. The refluxing thus induced assists in leaching the hydrocarbon constituents from the oil impregnated sands. The resulting hydrocarbon solution has a deisrably reduced surface tension which aids it transmigration to the producing well or wells.

The recovered mixture of the hydrocarbons and petroleum oil is distilled in order to separate one from another, recover both, and to recycle the light hydrocarbons to the injection well. Any conventional distillation apparatus can be used. It is particularly advantageous to feed the recovered admixture into a continuous stripping still, which provides just enough fractionation to distill the light hydrocarbons that comprise the hydrocarbon mixture from the higher hydrocarbons that constitute the petroleum oil. The condensed distillate is reused for repeated injection and extraction. Because of the inherent value of the light hydrocarbon mixture, it will be appreciated that care should be taken to guard against leakage during both the injection and recovery operations. Such care will afford the incidental advantage that the instant process is very clean and benign environmentally as compared to fire flooding, for example.

If desired, the hot oil withdrawn from the kettle of the stripping still may be heat exchanged with the condensed hydrocarbon distillate so as to preheat the latter in the process of recycling to the injection well.

A controlled superatmospheric pressure is imposed at the injection well in order to cause transmigration of the liquid hydrocarbon mixture leaching agent from the injection well to a proximate producing well. This pressure will be appreciably above the vapor pressure of the mixture in order to cause the liquid hydrocarbon solution to flow at a preselected rate through the producing horizon being treated.

While the process of this invention requires at least one injection well and at least one producing well, it will be appreciated that more than one of each can be used and in most instances will be used. Thus, the conventional array of one injection well surrounded by three to five producing wells can be employed.

Because of the inherent value of the light hydrocarbon leaching agents employed in this invention, it will be appreciated that losses of hydrocarbon from the oil reservoir under treatment must be avoided or kept within economically acceptable limits. Normally the oil/gas deposits are confined by a dome structure of impervious rock which is penetrated only by the injection and production wells. Occasionally, such confinement of the deposits is impaired by fractures in the rock formation that might permit the escape of gas or liquid into unconfined strata. Accordingly, it is recommended that the present invention be practiced after first testing the reservoir for the absence of unacceptable leakage by injecting a fluid under pressure into the reservoir to be treated, said fluid being confined under a pressure at least equivalent to the vapor pressure of the hydrocarbon liquid at the temperature of the reservoir. Suitable fluids for such preliminary pressure testing are water, air, or methane.

The continuous recycling of the recovered hydrocarbon leaching agent through the porous oil sand formation in the reservoir subjected to tertiary oil recovery by the process of this invention is continued until the incremental oil recovery has diminished to uneconomic proportions. Thereupon it is important that the leaching agent remaining in the reservoir be maximally recovered. This can be accomplished by well-known procedures including, first, distillation of the volatile hydrocarbons by reducing the back pressure of the production well and condensing the hydrocarbon vapors. This initial step may then be followed by methane flooding, water flooding, or a combination of these.

The above disclosure pertains specifically to enhanced oil recovery from oil-bearing sand in underground formations that have previously been subjected to the conventional primary and secondary recovery procedures. All of these recovery methods produce the oil from in situ reservoirs and structures by hydraulic means familiar to those skilled in the art. However, the principle as well as certain features of this invention are equally applicable and effective when applied to the extraction of petroleum fractions from tar sands that have been brought to the surface from underground deposits by conventional mining operations.

In this latter embodiment of the invention, the tar sands are charged to a large, enclosed pressure vessel provided with appropriately designed heating means and surmounted by a conduit or short distillation column, connected to a conventional water-cooled condensor. The heating means may, for example, be disposed in the form of hollow steam-heated vertical panels that traverse the cylindrical pressure vessel at intervals in such a manner as not to interfere with the charging and discharging of tar sands to and from said vessel.

Once the vessel has been charged with fresh tar sands, a light hydrocarbon (e.g., butane) or an LPG mixture is charged to the vessel until the charge of tar sands is immersed therein. The entire system is placed under a nitrogen blanket at a predetermined back pressure. Steam is then admitted to the heating elements in the still kettle, and the nitrogen back pressure is reduced until the kettle undergoes vigorous boiling. The vaporized light hydrocarbon fraction is condensed in the water-cooled condensor and refluxed to the still kettle. After a predetermined period of said refluxing, the nitrogen pressure on the system is raised well above the vapor pressure of the light hydrocarbon solvent at the temperature prevailing in the kettle liquid in contact with the steam-heated heating panels. The hot solution is then withdrawn (under the imposed nitrogen pressure) into a continuous stripping still, having a reboil kettle at its base and connected to a condensor at the top, which distills the light hydrocarbons away from the extracted petroleum fraction. This batch refluxing and extraction sequence is repeated one or more times until the incremental recovery of petroleum extract is too small to justify the processing cost.

When the solution of petroleum extract in light hydrocarbon solvent has been drained from the still kettle for the last time in a given extraction sequence, live steam is admitted to the bottom of the still kettle and the light hydrocarbon leaching agent remaining adsorbed on the exhausted tar sands is steam-distilled into the condensor which drains into a decanting receiver, from which the hydrocarbon layer is made into a storage tank. The exhausted tar sands are then discharged from the bottom of the still kettle through a conical discharge port and appropriately disposed. A new charge of fresh tar sands is then admitted through a charging hopper, and the entire procedure is repeated.

The invention will be more fully understood by reference to the following illustrative embodiments.

EXAMPLE I

An oil field core, 3½" diameter×12" long, from the Elaine field in Dimmit County, Texas is cemented into a steel pressure vessel, so as to prevent peripheral bypassing of the core, leaving a lower and an upper plenum with appropriate connections to permit the metering of a liquid leaching agent into the lower plenum and the simultaneous withdrawal of liquid effluent from the upper plenum.

The core is first subjected to water flooding by pumping water upwardly through the core with a superficial velocity of 1"/minute, while maintaining the core temperature at 190° F. and the system under a nitrogen pressure of 500 psig. The water flooding is continued until the incremental oil layer recovery (upon alternate filling and draining of a double receiver) is negligibly small. Thereupon the system is purged of water by reversing the flow until the compressed nitrogen issues from the lower plenum. The bleeding down of the nitrogen pressure is continued until all of the nitrogen has been vented from the system.

The core is again pressured with nitrogen until a system pressure of 565 psig is attained. A liquid hydrocarbon mixture analyzing 10% ethane, 52% propane, and 38% butanes is then metered into the lower plenum from a liquid storage tank under pressure at a rate equivalent to a superficial velocity through the core of 1"/minute. The core temperature is maintained at 190° F., and the nitrogen pressure in the upper chamber of the double receiver is maintained at 565 psig. The pumping is continued until the upper chamber of the double receiver is filled to 90% of its capacity with cooled liquid effluent from the upper plenum. The pumping is interrupted while the liquid contents are transferred from the upper into the lower chamber of the double receiver (the nitrogen pressure in both chambers having first been equalized). The nitrogen pressure is then reduced to 465 psig by bleeding nitrogen from the upper chamber of the double receiver. After an interval of 15 minutes the nitrogen pressure is again raised to 565 psig by admitting compressed nitrogen from an external pressure cylinder. After 15 minutes the nitrogen pressure is again reduced to 465 psig, thus causing the propane to boil inside the sandstone structure of the core. 15 minutes later the nitrogen pressure is again raised to 565 psig, thus causing the propane vapors to condense within the core where the ambient temperature is maintained at 190° F., (corresponding to a propane vapor pressure of 515 psig). This pulsing action which induces alternate boiling and condensation is repeated six times with a 15 minute cycle time, and thereupon the pumping of liquid hydrocarbon mixture is resumed as before until the upper chamber of the double receiver is again filled to 90% of its capacity.

The above sequence of operations is continued until the oil-freighted hydrocarbon solution withdrawn from the lower chamber of the double receiver fails to yield a significant crude oil residue upon fractionally distilling the mixture to recover the light hydrocarbon leaching agent.

Upon completion of the above experiment, the total oil recovery typically represents about 85% of the total crude oil initially present in the oil-saturated core. This compares with a total oil recovery in the range of 35–45% typically achieved by known combinations of primary, secondary and tertiary oil recovery methods.

EXAMPLE II

A three-necked 5-liter stainless steel kettle is charged with 4-liters of tar sands obtained from Alberta, Canada. The kettle is equipped with a copper coil through which hot water or steam may be circulated. The kettle is connected to a brine-cooled condenser which drains into a decanting receiver, from which the condensate may be refluxed to the kettle. The vent of the condensor is connected to a nitrogen supply through a series of pressure regulators which maintain the nitrogen pressure on the still system at a predetermined value. Refrigerated liquid butane is admitted from a charging burette through one of the necks of the three-necked distillation kettle until the sands are covered. Any vaporized butane is condensed and refluxed to the kettle. Heat is then admitted to the copper heating coils and the nitrogen pressure is regulated to induce vigorous boiling of the butane while permitting total condensation in the brine-cooled condensor. This refluxing is continued for one hour. The pressure on the system is then raised until it is well above the vapor pressure of the hot butane in the kettle. Thereupon the kettle liquid is withdrawn through a filter from the bottom of the kettle through a brine-cooled condensor into a refrigerated receiver.

The kettle liquid from the receiver is then distilled to recover the leaching agent and to determine the quantity of heavy petroleum fraction recovered in the above operation. The entire procedure is repeated to determine the incremental amounts of petroleum extract recoverable with each successive repetition. Finally the leaching agent remaining adsorbed on the residual said is steam distilled into the condensor and recovered from the decanting receiver.

These data serve to define the optimum relationship between length of each refluxing cycle and the number of cycles that are economically justified. In an experiment conducted as boave in which 2 refluxing/leaching cycles were employed the total recovery of extracted petroleum liquids represent 84.3% of the combustible organic components of the tar sands as determined by ignition and ashing of a representative sample of the tar sands charged.

EXAMPLE III

To further illustrate the process of this invention when applied to an actual underground oil deposit, the following proposed detailed operating procedure for conducting a field test is set forth.

Proposed Field Test Procedure

REQUIREMENTS

The field test will require a continuous stripping still and reasonable storage facilities at the site selected for the experiment. The formation should be gas-tight as determined by a pressure test. The reservoir is first subjected to full secondary recovery by conventional water flooding. During the secondary recovery operation a reasonable quantity of LPG (say 75,000 barrels) should be accumulated in storage tanks provided for the purpose.

PROCEDURE

Employ a pentagonal array of peripheral wells surrounding a concentric core well, as illustrated in FIG. 1. Start by pumping water into one of the peripheral wells (Well No. 1) and allow water to be produced from the concentric core well (No. 0). Then place Well No. 0 under a methane back pressure of say, 700 psig. The pressure depends on the reservoir temperature but should exceed the vapor pressure of the hydrocarbon solvent at the reservoir temperature. The desired back pressure is maintained by bleeding or supplying methane.

The LPG hydrocarbon solvent is then pumped into Well No. 1 against the back pressure maintained on the reservoir at Well No. 0 until the entire slug (e.g., 75,000 barrels) has been fed into the reservoir to form a bank of liquid LPG. As these liquids are pumped into the water-flooded reservoir, a corresponding quantity of water is withdrawn from Well No. 0, while maintaining the desired pressure on the methane blanket.

Once the intended slug of LPG has been forced into the reservoir, the innovative operation of this invention, the alternate boiling and condensation of said quantity of LPG is induced and controlled by alternately lowering and raising the back pressure by a substantial margin (at least +50 psi) at predetermined intervals. The proper length of the boiling and condensation periods is determined by heat transfer considerations within the reservoir.

It should be long enough to vaporize a substantial fraction of the LPG committed (e.g. 30%) and hence, it will depend on the size of the LGP slug and the temperature difference between the boiling point and the ambient temperature of the formation. This novel pressure-pulsing operation is continued for a number of cycles (to be determined by experience) sufficient to leach approximately half of the residual oil out of the formation and dissolve it in the LPG.

Thereupon, water is pumped into Well No. 0 and the hydrocarbon solution is produced through Well No. 1 by reverse flow until water breaks through. The entire operation is then precisely repeated at least once and possible twice to insure that all of the residual oil in the pocket so treated has been recovered to the point of diminishing returns. The solution of LPG and recovered oil is continuously passed through a stripping still in which the LPG and the recovered oil are separated. The recovered LPG is pumped to the LPG storage tank and recycled over and over again. It is expected that the losses of LPG attending this operation will be compensated at least in part by recovering hydrocarbon's in that boiling range from the crude oil recovered by Petroflooding.

Once the first pocket has thus been leached of its residual oil, the process is repeated with this difference: the introduction of the slug of say, 75,000 barrels of LPG, is followed by pumping an additional 75,000 barrels of water into Well 1, while withdrawing 150,000 barrels of water from Well 0. In this way, the LPG slug is forced into a second "pocket" geographically displaced toward Well 0. The pressure pulsing sequence is then conducted as before, and after its projected duration, the reverse flow displacement is initiated by pumping at least 150,000 barrels of water into Well 0. Well 1 will initially deliver 75,000 barrels of water and then more than 75,000 barrels of oil-LPG solution, the water pumping being continued until water breaks through at Well No. 1. The second pocket is thus refluxed two to four times, depending upon the incremental recovery achieved.

Thereupon, the operation is continued by invading a third pocket. The injection of 75,000 barrels of LPG is followed by 150,000 barrels of water while simultaneously withdrawing 225,000 barrels of water from Well 0.

After the succession of pockets has traversed half the distance between Well 1 and Well 0, the respective roles of Wells 1 and 0 may be reversed. The entire sequence of operations is then repeated by working with other pairs of wells in the array, such as Well No. 2 and Well No. 0, Well No. 3 and Well No. 0, Wells 4 and 0, 5 and 0, 1 and 2, 2 and 3, 3 and 4, 4 and 5, 5 and 1, 1 and 3, 2 and 4, 3 and 5, 4 and 1, and 5 and 2. Other geometric arrays may be devised that will prove equally efficient in forming corridors that sweep the reservoir.

The above procedure provides a method of attaining high oil extraction efficiency by employing a powerful solvent totally miscible with the extracted oil while insuring effective penetration of the pore structure by a controlled in situ refluxing of light hydrocarbons. The resultant solution of extracted oil in the LPG solvent has desirably low surface tension and viscosity.

The employment of alternating slugs of LPG and water in conjunction with a geometrically disposed array of injection and production wells assures high volumetric efficiency in sweeping the total pore space with a modest inventory of LPG.

Various changes and modifications can be made in the process of this invention without departing from the spirit and scope thereof. It will be further understood that the embodiments disclosed herein are for the purpose of illustrating but not limiting the invention.

What is claimed is:

1. Process for the enhanced recovery of petroleum from partially depleted underground deposits which comprises the steps of (a) introducing into an oil-bearing deposit a non-condensible gas to establish a gas cushion of non-condensible gas with a back pressure at a regulated pressure level; (b) introducing a liquid mixture of light hydrocarbons into said underground oil deposit through at least one injection well penetrating said deposit against the back pressure of said non-condensible gas cushion, said back pressure being sufficient to maintain said hydrocarbon mixture in the liquid state at the temperature of said deposit (c) lowering the pressure of said non-condensible gas by withdrawing a portion of said non-condensible gas through at least one production well penetrating said oil deposit until the pressure within said deposit is lower than the vapor pressure of said light hydrocarbon mixture and maintaining this lower pressure until at least 20% of said hydrocarbon mixture has vaporized; (d) reintroducing said non-condensible gas through said production well to raise the pressure within said petroleum deposit substantially above the vapor pressure of said light hydrocarbon mixture and maintaining the higher pressure until substantially all of the vaporized light hydrocarbon mixture has condensed within said deposit; (e) repeating the boiling and condensation sequence one or more times; and (f) then producing the resultant solution of extracted oil dissolved in said light hydrocarbon mixture by means of an appropriate displacement fluid.

2. Process for the enhanced recovery of petroleum from a partially depleted oil-bearing formation which comprises the following steps (a) subjecting said oil-bearing formation to conventional water flooding until the resultant oil recovery has reached uneconomic proportions; (b) introducing into said oil-bearing formation a non-condensible gas to establish a gas cushion of non-condensible gas with a back pressure at a regulated pressure level; (c) introducing into said oil-bearing formation a measured quantity of light, liquid hydrocarbons through at least one injection well penetrating said oil-bearing formation by displacing a substantially equal volume of water toward at least one production well penetrating said formation and withdrawing an equivalent slug of water from said production well while maintaining a back pressure on said formation by means of said cushion of non-condensible gas maintained above the vapor pressure of said slug of light liquid hydrocarbons (d) lowering the back pressure on said formation by withdrawing gas from said gas cushion through one or more production wells until the pressure within said formation is substantially below the vapor pressure of said light liquid hydrocarbon mixture and maintaining said lower pressure until at least a substantial fraction of said hydrocarbon liquid has vaporized; (e) reintroducing said non-condensible gas through said production well to raise the pressure within said petroleum deposit substantially above the vapor pressure of said light hydrocarbon mixture and maintaining the higher pressure until substantially all of the vaporized light hydrocarbon mixture has condensed within said deposit; (f) repeating the boiling and condensation sequence one or more times; and, (g) then producing the resultant solution of extracted oil dissolved in said light hydrocarbon mixture by means of an appropriate displacement fluid.

3. Process for the enhanced recovery of crude petroleum from partially depleted underground deposits thereof which utilizes a conventional array of wells penetrating said deposit to introduce thereto and withdraw therefrom a measured quantity or bank of light hydrocarbon solvent capable of dissolving a portion of the crude petroleum retained in said deposit, said process comprising the following steps:

(a) employing a conventional water flood following completion of the unassisted, or primary, production of petroleum from said deposit and maintaining this secondary recovery operation until the incremental recovery of petroleum has diminished to uneconomic proportions;

(b) introducing through at least one of the wells in said array, a non-condensible gas until the pressure in the pore structure of said deposit has reached a value substantially above the vapor pressure of said light hydrocarbon solvent at the ambient temperature of said deposit;

(c) introducing a measured quantity, or bank, of said light hydrocarbon solvent as a liquid to said deposit through at least one designated injection well of said array and positioning said bank in a predetermined area of said deposit by displacing an appropriate quantity of water from a designated production well in said array and injecting an additional quantity of water through said injection well to displace said bank of light hydrocarbon solvent to the selected area within said deposit;

(d) withdrawing a portion of said non-condensible gas from at least one of the wells in said array so as to lower the pressure in the pore structure of said deposit to a value substantially below the vapor pressure of said light hydrocarbon solvent at the ambient temperature of said deposit, and maintaining this reduced pore pressure until at least 20% of the light hydrocarbon solvent in said bank has been vaporized;

(e) reinjecting said non-condensible gas through a selected well in said array so as to raise the pressure in the pore structure of said deposit to a value substantially above the vapor pressure of said light hydrocarbon solvent at the ambient temperature of said deposit, and maintaining this higher pressure until the previously vaporized light hydrocarbon solvent has substantially recondensed;

(f) repeating the cycle of vaporization and condensation of said light hydrocarbon solvent one or more times by alternately lowering and raising the back pressure of non-condensible gas imposed on said deposit; and (g) finally, producing said bank of light hydrocarbon solvent together with the extracted crude petroleum dissolved therein by displacing said bank toward a designated production well with a displacement fluid introduced through a designated injection well in said array.

4. Process as in claims 1, 2 or 3 in which the light hydrocarbon solvent is a mixture of aliphatic hydrocarbons containing 2 to 5 carbon atoms.

5. Process as in claims 1, 2 or 3 in which the light hydrocarbon solvent is a liquified petroleum gas.

6. Process as in claims 1, 2 or 3 in which the light hydrocarbon solvent is a low boiling naphtha fraction.

7. Process as in claims 1, 2 or 3 in which the displacement fluid is water.

8. Process as in claims 1, 2 or 3 in which the displacement fluid is an aqueous solution of a viscosity-enhancing organic polymer.

9. Process as in claims 1, 2 or 3 in which the non-condensible gas is selected from the group comprising methane, air, nitrogen-rich combustion products.

10. Process as in claims 1, 2 or 3 in which the conventional array of wells is in the form of a 5-spot, 7-spot or 9-spot pattern comprising respectively a square with a concentric well, a hexagon with a concentric well, and an octagon with a concentric well.

11. Process as in claims 1, 2 or 3 in which the produced solution of light hydrocarbon solvent and extracted petroleum is separated by fractional distillation, and the light hydrocarbon solvent fraction is reintroduced to said underground deposit.

* * * * *